US010193228B2

(12) United States Patent
Dudley et al.

(10) Patent No.: US 10,193,228 B2
(45) Date of Patent: Jan. 29, 2019

(54) ANTENNA FOR NEAR FIELD SENSING AND FAR FIELD TRANSCEIVING

(71) Applicant: The United States of America as represented by the Administrator of the National Aeronautics and Space Administration, Washington, DC (US)

(72) Inventors: Kenneth L. Dudley, Newport News, VA (US); George N. Szatkowski, Charlottesville, VA (US); Chuantong Wang, Newport News, VA (US); Laura J. Smith, Yorktown, VA (US); Larry A. Ticatch, Yorktown, VA (US); Sandra V. Koppen, Suffolk, VA (US); Truong X. Nguyen, Hampton, VA (US); Jay J. Ely, Yorktown, VA (US)

(73) Assignee: The United States of America as represented by the Administrator of NASA, Washington, DC (US)

( * ) Notice: Subject to any disclaimer, the term of this patent is extended or adjusted under 35 U.S.C. 154(b) by 959 days.

(21) Appl. No.: 14/520,863

(22) Filed: Oct. 22, 2014

(65) Prior Publication Data

US 2017/0301994 A1 Oct. 19, 2017

Related U.S. Application Data

(60) Provisional application No. 61/895,066, filed on Oct. 24, 2013.

(51) Int. Cl.
*H01Q 7/00* (2006.01)
*H01Q 9/27* (2006.01)
(Continued)

(52) U.S. Cl.
CPC ..... *H01Q 7/005* (2013.01); *H01Q 1/36* (2013.01); *H01Q 1/38* (2013.01); *H01Q 7/00* (2013.01); *H01Q 9/27* (2013.01)

(58) Field of Classification Search
CPC .. H01Q 7/00; H01Q 1/22; H01Q 1/38; H01Q 7/005; H01Q 9/27; H01Q 1/36
See application file for complete search history.

(56) References Cited

U.S. PATENT DOCUMENTS 5,349,271 A 9/1994 Van Os et al.
5,436,528 A 7/1995 Paranjpe
(Continued)

FOREIGN PATENT DOCUMENTS

GB 2293050 A * 3/1996 ..... H01Q 1/22

OTHER PUBLICATIONS

PCT International Search Report PCT/US2014/062124, pp. 1-10, dated Feb. 6, 2015.
(Continued)

*Primary Examiner* — Jessica Han
*Assistant Examiner* — Michael Bouizza
(74) *Attorney, Agent, or Firm* — Robin W. Edwards; Mark P. Dvorscak

(57) ABSTRACT

An antenna includes a first electrical conductor that is shaped to form a spiral between its first and second ends that remain electrically unconnected such that the first electrical conductor so-shaped is maintained as an unconnected single-component open-circuit having inductance and capacitance. In the presence of a time-varying electromagnetic field, the first electrical conductor so-shaped resonates to generate a harmonic electromagnetic field response having a frequency, amplitude and bandwidth. A second electrical conductor includes a loop portion overlapping at least a portion of the spiral. The second electrical conductor is
(Continued)

electrically isolated from the first electrical conductor. A radio frequency transceiver capable of transmitting and receiving electromagnetic energy is electrically coupled to the second electrical conductor.

21 Claims, 4 Drawing Sheets

(51) Int. Cl.
*H01Q 1/36* (2006.01)
*H01Q 1/38* (2006.01)

(56) References Cited

U.S. PATENT DOCUMENTS

| | | | | |
|---|---|---|---|---|
| 5,874,704 | A | 2/1999 | Gates | |
| 7,086,593 | B2 | 8/2006 | Woodard et al. | |
| 7,159,774 | B2 | 1/2007 | Woodard et al. | |
| 8,430,327 | B2 | 4/2013 | Woodard et al. | |
| 2004/0019272 | A1 | 1/2004 | Witcraft | |
| 2005/0007239 | A1 | 1/2005 | Woodard et al. | |
| 2005/0179604 | A1* | 8/2005 | Liu | G06K 19/07749 343/742 |
| 2007/0181683 | A1 | 8/2007 | Woodard | |
| 2008/0184795 | A1 | 8/2008 | Woodard et al. | |
| 2009/0040116 | A1 | 2/2009 | Eray | |
| 2009/0072814 | A1 | 3/2009 | Woodard et al. | |
| 2009/0109005 | A1 | 4/2009 | Woodard et al. | |
| 2009/0273429 | A1 | 11/2009 | Nakamura et al. | |
| 2009/0302111 | A1 | 12/2009 | Woodard et al. | |
| 2010/0026202 | A1 | 2/2010 | Siessegger | |
| 2010/0059692 | A1 | 3/2010 | Quick, II | |
| 2010/0109818 | A1 | 5/2010 | Woodard et al. | |
| 2011/0274139 | A1 | 11/2011 | Woodard et al. | |
| 2011/0292969 | A1 | 12/2011 | Woodard | |
| 2012/0271564 | A1 | 10/2012 | Dudley et al. | |
| 2013/0033271 | A1 | 2/2013 | Woodard | |
| 2014/0091149 | A1* | 4/2014 | Finn | G06K 19/07769 235/492 |

OTHER PUBLICATIONS

PCT International Search Report PCT/US2014/062102, pp. 1-12, dated Feb. 2, 2015.

PCT International Search Report PCT/US2014/062097, pp. 1-12, dated Feb. 9, 2015.

Dudley et al. Damage Detection Response Characteristics of Open Circuit Resonant (SansEC) Sensors. 2013 ICOLSE International Conference on Lightning and Static Electricity, Sep. 17-20, 2013, pp. 1-13, Seattle, Washington.

Urrutia, et al, "Nonlinear electron magnetohydrodynamic physics. VI. Magnetic loop antenna across the ambient field", Phys Plasmas, 2009, vol. 16, pp. 022102-1-022102-10.

Woodard, Stanley E., "A Magnetic Field Response Recorder: A New Tool for Measurement Acquisition," 5th Annual IEEE Conference on Sensors, Oct. 22-25, 2006, pp. 789-797, Daegu, Korea.

Woodard, Stanley E et al., "Measurement of Multiple Unrelated Physical Quantities using a Single Magnetic Field Response Sensor," Measurement Science and Technology, 2007, vol. 18 pp. 1603-1613.

Smith, Douglas C. et al., "Signal and Noise Measurement Techniques Using Magnetic Field Probes," 1999 IEEE International Symposium on Electromagnetic Compatibility, Aug. 2-6, 1999, pp. 559-563, Seattle Washington.

Ely, Jay J. et at. "Investigation of Electromagnetic Field Threat to Fuel Tank Wiring of a Transport Aircraft," Mar. 2000, NASA/TP-2000-209867, pp. 1-200.

ETS Lindgren, Model 7405 Near-Field Probe Set User Manual, 1999, pp, 1-51.

* cited by examiner

ANTENNA FOR NEAR FIELD SENSING AND FAR FIELD TRANSCEIVING

CROSS-REFERENCE TO RELATED PATENT APPLICATION(S)

This patent application claims the benefit of and priority to U.S. Provisional Application Ser. No. 61/895,066, filed on Oct. 24, 2013, the contents of which are hereby incorporated by reference in their entirety. In addition, this application is related to co-pending patent applications titled "MUM-LAYER. WIRELESS SENSOR CONSTRUCT FOR USE AT ELECTR1CALLY-CONDUCTIVE MATERIAL SURFACES," U.S. patent application Ser. No. 14/520,785 and "PLASMA GENERATOR USING SPIRAL CONDUCTORS," U.S. patent application Ser. No. 14/520,679, filed on the same day and owned by the same assignee as this patent application, the contents of which are hereby incorporated by reference in their entirety.

STATEMENT REGARDING FEDERALLY SPONSORED RESEARCH OR DEVELOPMENT

The invention described herein was made in the performance of work under a NASA contract and by employees of the United States Government and is subject to the provisions of Public Law 96-517 (35 U.S.C. § 202) and may be manufactured and used by or for the Government for governmental purposes without the payment of any royalties thereon or therefore. In accordance with 35 U.S.C. § 202, the contractor elected not to retain title.

BACKGROUND OF THE INVENTION

Recently, a new class of wireless sensing systems have been developed that use open-circuit, electrically-conductive spiral trace sensors. Details of these sensors and sensing systems are described in U.S. Pat. No. 8,430,327. Briefly, the described wireless sensing system includes a sensor made from an electrical conductor shaped to form an open-circuit, electrically-conductive spiral trace having inductance and capacitance. In the presence of a time-varying magnetic field, the sensor resonates to generate a harmonic response having a frequency, amplitude and bandwidth. A magnetic field response recorder wirelessly transmits the time-varying magnetic field to the sensor and wirelessly detects the sensor's response.

The above-described wireless sensing technology provides a new technical framework for designing, powering, and interrogating sensors. These unique sensors can detect physical changes in the environment or any material placed within the near field (i.e., millimeters to tens of centimeters) of the sensor. Detected changes are generally associated with a localized change in a material's permittivity, permeability, and/or conductivity. The material may be any state of matter, plasma, gas, liquid, or solid. Changes to a material's state cause disturbances in the wireless sensor's magnetic field that can be sensed by a magnetic field response recorder. Since the sensor's magnetic field is limited to the near field, the recorder's antenna must also be in the sensor's near field, thereby limiting the number of applications that can use this technology.

BRIEF SUMMARY OF THE INVENTION

The present invention is an antenna that includes a first electrical conductor having first and second ends. The first electrical conductor is shaped to form a spiral between its first and second ends that remain electrically unconnected such that the first electrical conductor so-shaped is maintained as an unconnected single-component open-circuit having inductance and capacitance. In the presence of a time-varying electromagnetic field, the first electrical conductor so-shaped resonates to generate a harmonic electromagnetic field response having a frequency, amplitude and bandwidth. A second electrical conductor includes a loop portion overlapping at least a portion of the spiral. The second electrical conductor is electrically isolated from the first electrical conductor. A radio frequency transceiver capable of transmitting and receiving electromagnetic energy is electrically coupled to the second electrical conductor.

One embodiment of the invention further includes a third electrical conductor having first and second ends. The third electrical conductor is shaped to form a second spiral between its first and second ends that remain electrically unconnected such that the third electrical conductor so-shaped is maintained as an unconnected single-component open-circuit having inductance and capacitance. In the presence of a time-varying electromagnetic field, the third electrical conductor so-shaped resonates to generate a harmonic electromagnetic field response having a frequency, amplitude and bandwidth. The loop portion of the second electrical conductor is disposed between the spiral and the second spiral.

Another embodiment of the invention is an antenna that includes a first electrical conductor having first and second ends. The first electrical conductor is shaped to form a spiral between its first and second ends. The spiral lies in a first plane. The first electrical conductor's first and second ends remain electrically unconnected such that the first electrical conductor so-shaped is maintained as an unconnected single-component open-circuit having inductance and capacitance. In the presence of a time-varying electromagnetic field, the first electrical conductor so-shaped resonates to generate a harmonic electromagnetic field response having a frequency, amplitude and bandwidth. A second electrical conductor includes a loop portion lying in a second plane that can be parallel to the first plane. The loop portion overlaps at least a portion of the spiral. The second electrical conductor is electrically isolated from the first electrical conductor. A radio frequency transceiver capable of transmitting and receiving electromagnetic energy is electrically coupled to the second electrical conductor.

These and other features, advantages, and objects of the present invention will be further understood and appreciated by those skilled in the art by reference to the following specification, claims, and appended drawings.

DETAILED DESCRIPTION OF THE INVENTION

Figure 1:
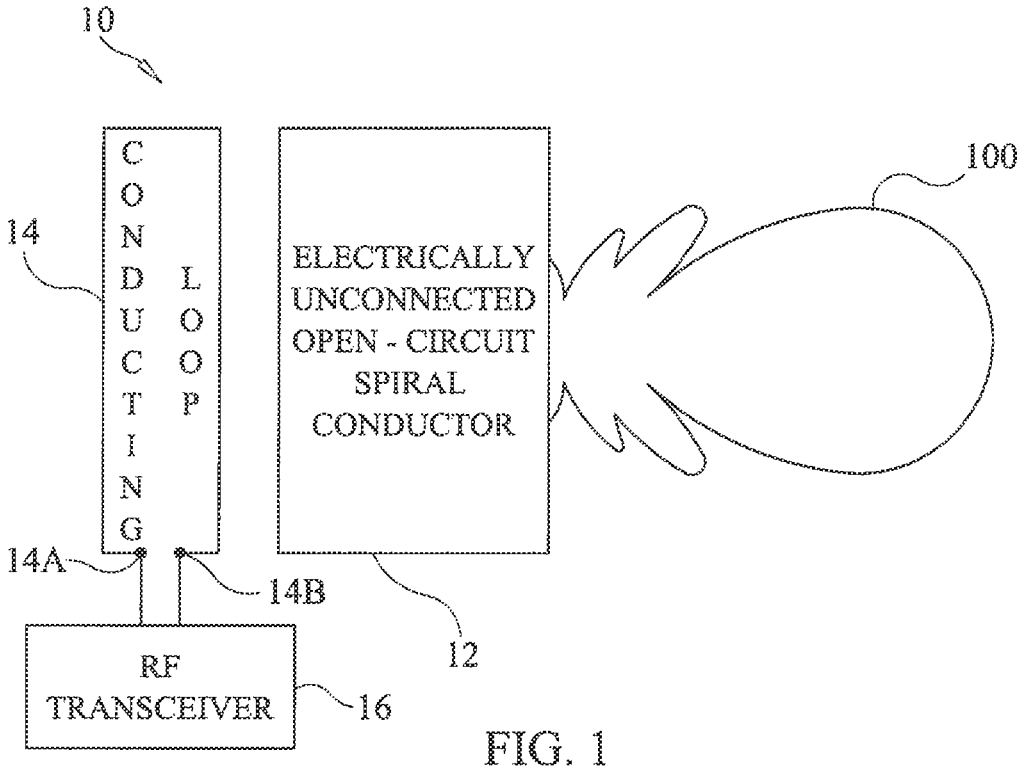
FIG. 1 is a schematic view of an antenna having far field transceiving capabilities in accordance with an embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood, that the specific devices and processes illustrated in the attached drawings, and described in the following specification, are simply exemplary embodiments of the inventive concepts defined in the appended claims. Hence, specific dimensions, relative dimensions, and/or other physical characteristics relating to the embodiments disclosed herein are not to be considered as limiting, unless the claims expressly state otherwise.

Referring now to the drawings and more particularly to FIG. 1, an antenna having far field transceiving capabilities in accordance with an embodiment of the present invention is shown and is referenced generally by numeral 10. In general, antenna 10 is capable of transmitting and receiving radio frequency energy in accordance with a far field energy pattern referenced by numeral 100. The term "far field" as used herein refers to distances on the order of a meter to tens of meters. By way of an illustrative example and as will be explained further below, antenna 10 can be used to increase or boost the read range of wireless sensors of the type described in the above-describe mentioned U.S. Pat. No. 8,430,327, whose interrogation or reading has previously been limited to "near field" read ranges on the order of millimeters to tens of centimeters.

Antenna 10 includes an electrically unconnected, open-circuit spiral conductor 12, an electrically conducting loop 14 electrically isolated from spiral conductor 12, and a radio frequency (RF) transceiver 16 electrically coupled/connected to conducting loop 14. Transceiver 16 is any device/system capable of transmitting time-varying electromagnetic energy to loop 14 and measuring electromagnetic energy received by loop 14. Such RP transceiver devices/systems are well understood in the art.

Figure 2:
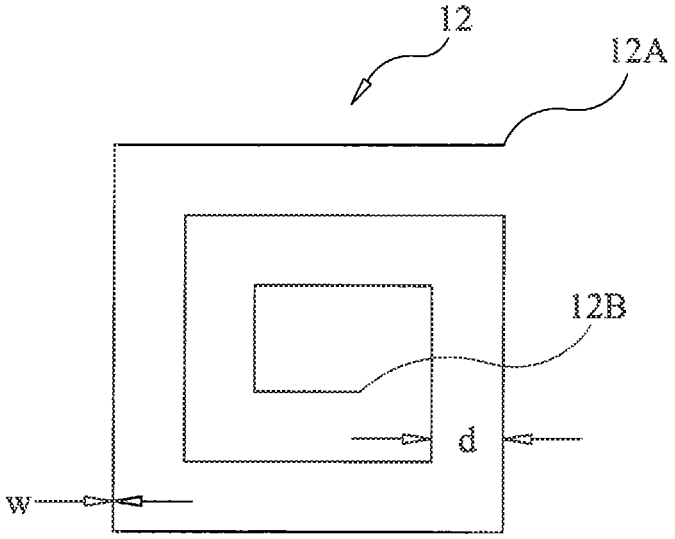
FIG. 2 is an isolated schematic view of an embodiment of an electrically-unconnected spiral conductor used in the antenna of the present invention.

Antenna 10 includes an electrically unconnected, open-circuit spiral conductor 12. Spiral conductor 12 and its attributes are described in detail in U.S. Pat. No. 8,430,327, the entire contents of which are hereby incorporated by reference. Briefly, and with reference to FIG. 2, spiral conductor 12 is made from an electrically-conductive run or trace. More specifically, spiral conductor 12 is a spiral winding of conductive material with its ends 12A and 12B remaining open or unconnected. Accordingly, spiral conductor 12 is said to be an open-circuit. Techniques used to construct or deposit spiral conductor 12 on a substrate material can be any conventional metal-conductor deposition process to include thin-film fabrication techniques. En the illustrated embodiment, spiral conductor 12 is constructed to have a uniform trace width throughout (i.e., trace width W is constant) with uniform spacing (i.e., spacing d is constant) between adjacent portions of the spiral trace. However, it is to be understood spiral conductor 12 is not limited to a uniform-width conductor spirally wound with uniform spacing as illustrated in FIG. 2.

Conducting loop 14 is essentially a loop formed by an insulated or uninsulated electrical conductor where the two ends 14A and 14B of the loop are electrically connected to transceiver 16. Conducting loop 14 is electrically isolated from spiral conductor 12 by air or some other dielectric material. When loop 14 is excited by electromagnetic energy from transceiver 16, the electromagnetic energy is coupled to spiral conductor 12 thereby exciting spiral conductor 12 into resonance to generate radiation pattern 100. Structural factors affecting the frequency and power of radiation pattern 100 include the attributes of spiral conductor 12, the attributes of loop conductor 14, the input provided by transceiver 16, and the physical relationship between spiral conductor 12 and loop 14. These structural factors impact one or more of a number of electrical factors to include impedance, resonant frequency, VSWR (Voltage Standing Wave Ratio), efficiency, bandwidth, gain, radiation pattern, and polarization. Each of these electrical factors as they relate to the present invention will be discussed briefly below.

Complex impedance of an antenna is related to the electrical length of the antenna at the wavelength (i.e., inverse of frequency) in use. The impedance is most commonly adjusted at the antenna (i.e., spiral conductor 12 in the present invention) by means of changing the electrical length of spiral conductor 12, the capacitance (gap width) of spiral conductor 12, the inductance (trace width) of spiral conductor 12, or combinations of such changes. The impedance of spiral conductor 12 can also be matched to the feed (i.e., loop 14 in the present invention) and the source (i.e., transceiver 16 in the present invention) by adjusting the impedance of loop 14 via changes in the diameter and circumference of loop 14 thereby essentially using loop 14 as an impedance transformer. The impedance may also be adjusted by varying the permittivity value and/or thickness of a dielectric (see FIG. 3) between loop 14 and spiral conductor 12. Finally, the impedance of transceiver 16 can be adjustable by electronic means.

Resonance is the tendency of a system to oscillate with greater amplitude at some frequencies than at others. Electrical resonance occurs at the fundamental resonant frequency when the total impedance of the system that contains the transceiving elements of antenna 10 matches the source impedance of transceiver 16. At the fundamental resonant frequency, a standing wave is presented along spiral conductor 12. The standing wave has current minimums and voltage maximums at the end-points of spiral conductor 12 and current maximum and voltage minimum approximately half-way between spiral conductor 12 and its end-points. The voltage minima are centered in the vicinity of the feed-point for loop 14, thus presenting lower impedance than at other frequencies. Also, the large current and small voltage are in phase at that point resulting in a purely resistive impedance allowing for maximum energy transfer from and/or to transceiver 16, whereas away from the design frequency the feed-point impedance rises and becomes reactive and impedes energy transfer.

Standing wave ratio (SWR) is the ratio of the amplitude of a partial standing wave at a maximum to the amplitude at an adjacent minimum along an electrical transmission path, The most common case for measuring and examining SWR is when installing and tuning antennas. When a transmitter is connected to an antenna by a feed line, the impedance of the antenna and feed line must match exactly for maximum energy transfer from the feed line to the antenna. The SWR is usually defined as a voltage ratio called the VSWR, for voltage standing wave ratio. In general, antenna 10 should have an impedance that is resistive and near the characteristic impedance of the transmission path from transceiver 16 to spiral conductor 12 in order to minimize the standing wave ratio (SWR) and the increase in transmission path losses it entails, in addition to supplying a good match at transceiver 16. Accordingly, SWR is used as an efficiency measure for transmission paths that conduct radio frequency signals from transmitters and receivers to their antennas.

The efficiency of an antenna relates the power delivered to the antenna and the power radiated or dissipated within the antenna. The power supplied to an antenna's terminals that is not radiated is converted into heat. This is usually due to loss resistance in the antenna's conductors, but can also be due to dielectric or magnetic core losses in antennas (or antenna systems) using such components. Such loss effectively robs power from the transmitter or receiver requiring a stronger transmitter in order to transmit a signal of a given strength or amplifiers to receive small signals. In terms of the present invention, loss resistance will generally affect the feedpoint impedance of loop 14 and any dielectric losses occurring between spiral conductor 12 and loop 14 adding to its resistive (real) component. The real resistance component consists of the sum of the radiation resistance from spiral conductor 12 and the loss resistance from loop 14 and any dielectric between spiral conductor 12 and loop 14.

Bandwidth describes the range of frequencies over which the antenna can properly radiate or receive energy. An antenna's bandwidth specifies the range of frequencies over which its performance does not suffer due to a poor impedance match. Typical spiral antennas have wide bandwidths on the order of 180% while typical planer microstrip antennas have narrow bandwidths on the order of 3%. Spiral conductor 12 functions as a hybrid of these two antenna types. That is, spiral conductor 12 presents a number of periodic harmonics, each with a narrow resonance bandwidth but across a wide frequency band.

Antenna gain is a parameter that provides a measure of the deuce of directivity of the antenna's radiation pattern. A high-gain antenna will preferentially radiate in a particular direction. Specifically, the antenna gain or power gain of an antenna is defined as the ratio of the intensity radiated by the antenna in the direction of its maximum output, at an arbitrary distance, divided by the intensity radiated at the same distance by a hypothetical isotropic antenna. The gain of antenna 10 is a parametric governed by the geometry of spiral conductor 12 that radiates predominantly in a direction perpendicular to the plane of spiral conductor 12 to produce radiation pattern 100.

Antenna radiation pattern defines the variation of the power radiated by an antenna as a function of the direction away from the antenna. This power variation as a function of the arrival angle is observed in the antenna's far field. The radiation pattern of an antenna is plotted as the relative field strength of the radio waves emitted by the antenna at different angles. It is typically represented by a three-dimensional graph or polar plot of the horizontal and vertical cross sections. Antenna 10 radiates predominantly in a direction perpendicular to the plane of spiral conductor 12 to produce radiation pattern 100.

The polarization of an antenna refers to the orientation of the electric field (E-plane) of the radio wave with respect to the Earth's surface and is determined by the physical structure of the antenna and by its orientation. In the far field, the magnetic field of a radio wave is at right angles to that of the electric field. However, by convention, an antenna's "polarization" is understood to refer to the direction of the electric field. Polarization is predictable from an antennas geometry. In the present invention, polarization of antenna 10 is circular as it is governed by the geometry of spiral conductor 12.

Figure 3:
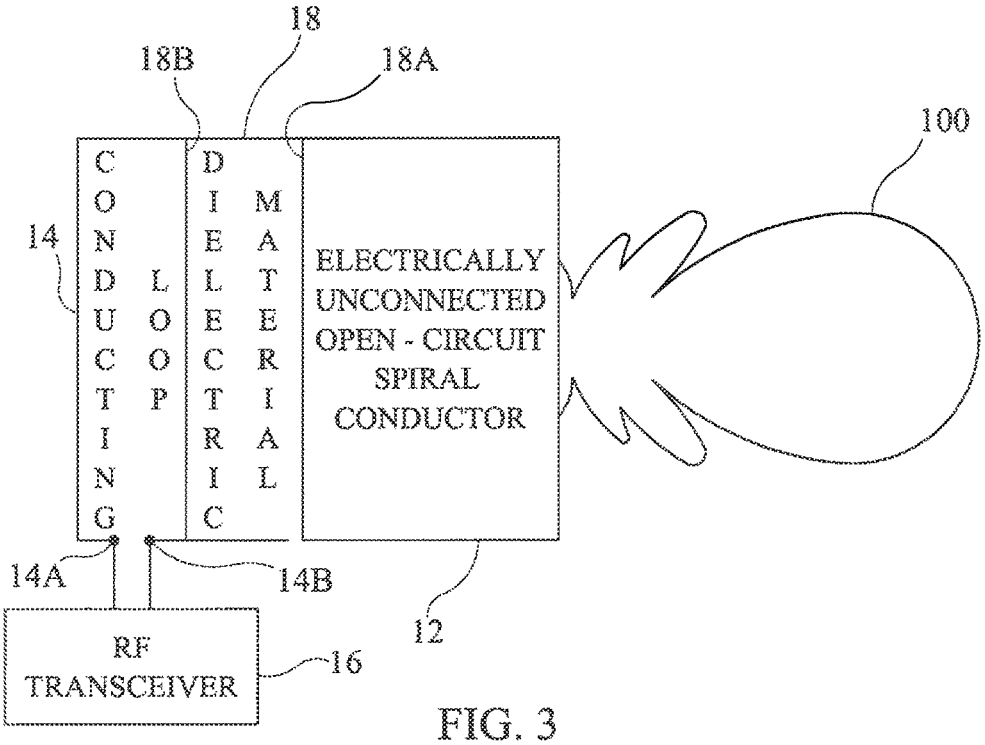
FIG. 3 is a schematic view of an antenna having elements that form a one-piece structure in accordance with another embodiment of the present invention.

The Physical relationship between spiral conductor 12 and loop 14 can be fixed. For example, FIG. 3 illustrates an embodiment of the present invention in which a dielectric material 18 interposed between spiral conductor 12 and loop 14 is used to construct a one-piece structure with spiral conductor 12 coupled to one face 18A of dielectric material 18 and loop 14 coupled to the opposing face 18B of dielectric material 18. If surfaces 18A and 18B are parallel to one another, spiral conductor 12 and loop 14 reside in parallel planes. The dielectric material could also be used to completely encase spiral conductor 12 and loop 14 without departing from the scope of the present invention.

Figure 4:
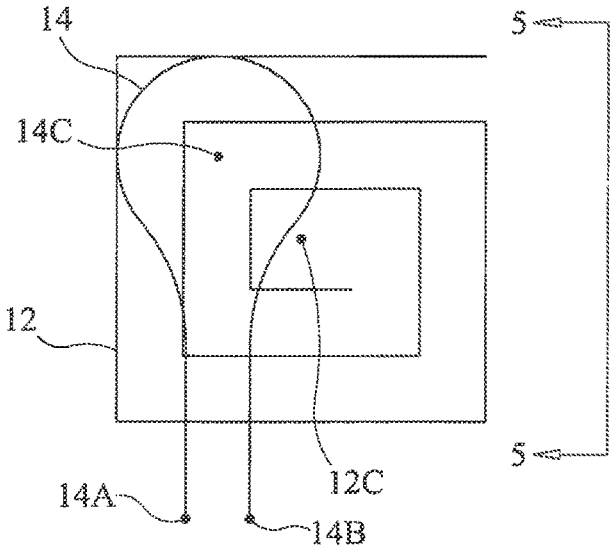
FIG. 4 is a plan view of the antenna's spiral conductor and loop portion in accordance with an embodiment of the present invention.
Figure 5:
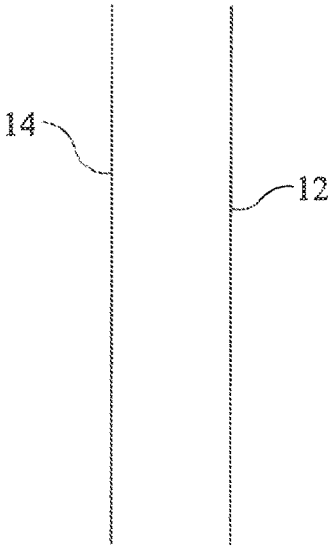
FIG. 5 is a side view of the spiral conductor and loop portion taken along line 5-5 in FIG. 4 illustrating the antenna's spiral conductor and loop portion arranged in parallel planes in accordance with an embodiment of the present invention.
Figure 6:
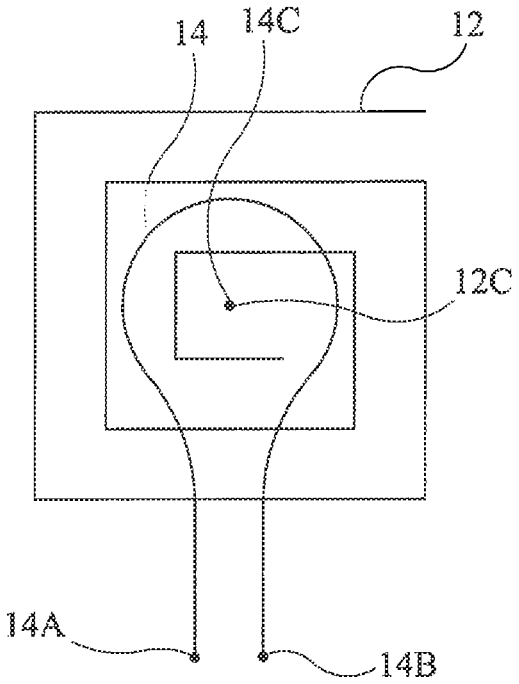
FIG. 6 is a plan view of the antenna's spiral conductor and loop portion with their geometric centers aligned in accordance with another embodiment of the present invention.

In order for the electromagnetic energy in loop 14 to be coupled to spiral conductor 12, loop 14 must overlap at least a portion of spiral conductor 12 (as illustrated in the plan view shown in FIG. 4) while remaining electrically isolated therefrom. For example, spiral conductor 12 and loop 14 can reside in parallel planes as illustrated by the side view shown in FIG. 5. Each of spiral conductor 12 and loop 14 has a geometric center 12C and 14C, respectively. The antenna efficiency of the present invention can be adjusted by the relationship between geometric centers 12C and 14C with the highest antenna efficiency being achieved when geometric centers 12C and 14C are aligned with one another as shown in FIG. 6. When spiral conductor 12 and loop 14 are in parallel planes, alignment of the geometric centers is achieved when the distance between centers 12C and 14C is the same as the distance between the parallel planes of spiral conductor 12 and loop 14.

Figure 7:
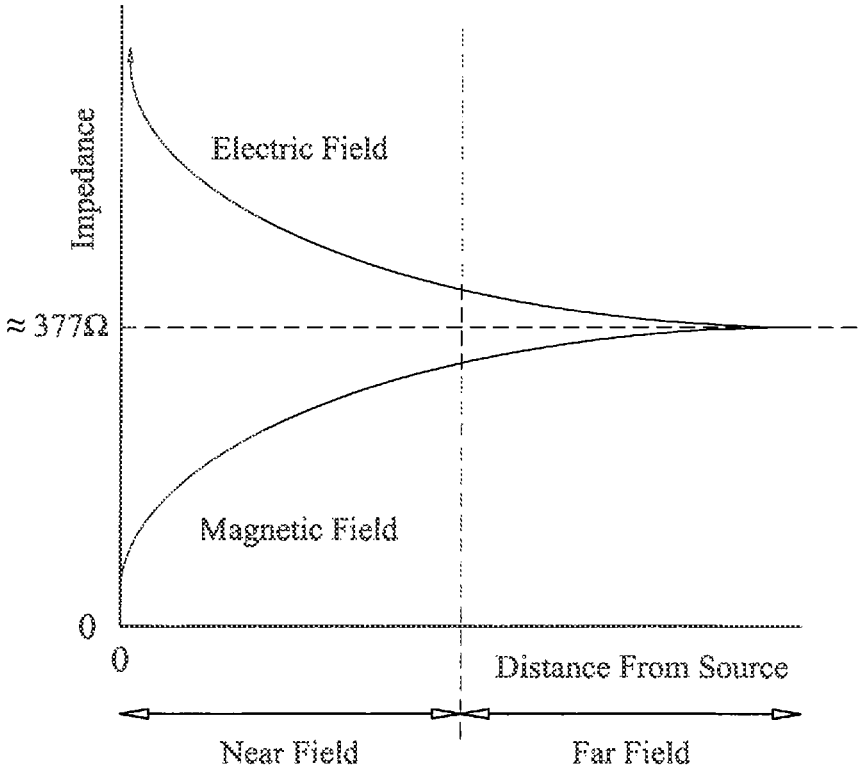
FIG. 7 is a generalized graph of field impedance illustrating the far field propagation of time-varying electromagnetic energy.

The far field operational range of antenna 10 can be explained as follows. The proximity of loop 14 to spiral conductor 12 is such that electromagnetic energy can be transferred between the two elements. More specifically, a time-varying electromagnetic field has both electric and magnetic components. The electric component establishes an electric field between the conductive traces (i.e., capacitance) of spiral conductor 12 and the magnetic component establishes a magnetic field as flux loops around the conductive traces (i.e., inductance) of spiral conductor 12. In terms of propagation through free-space (i.e., air), propagation distance is maximized by using electromagnetic energy as opposed to pure electric energy or pure magnetic energy. This is evidenced by the field impedance graph shown in FIG. 7 where far field propagation is achieved when electromagnetic energy propagating from/to antenna 10 is impedance-matched to free-space impedance of approximately 377 ohms. Accordingly, antenna 10 relies on a time-varying electromagnetic field to assure that the radiation pattern can propagate into (and be detected from) the far field. By coupling spiral conductor 12 to source-fed loop 14, a far field antenna is created for purposes of communication.

Figure 8:
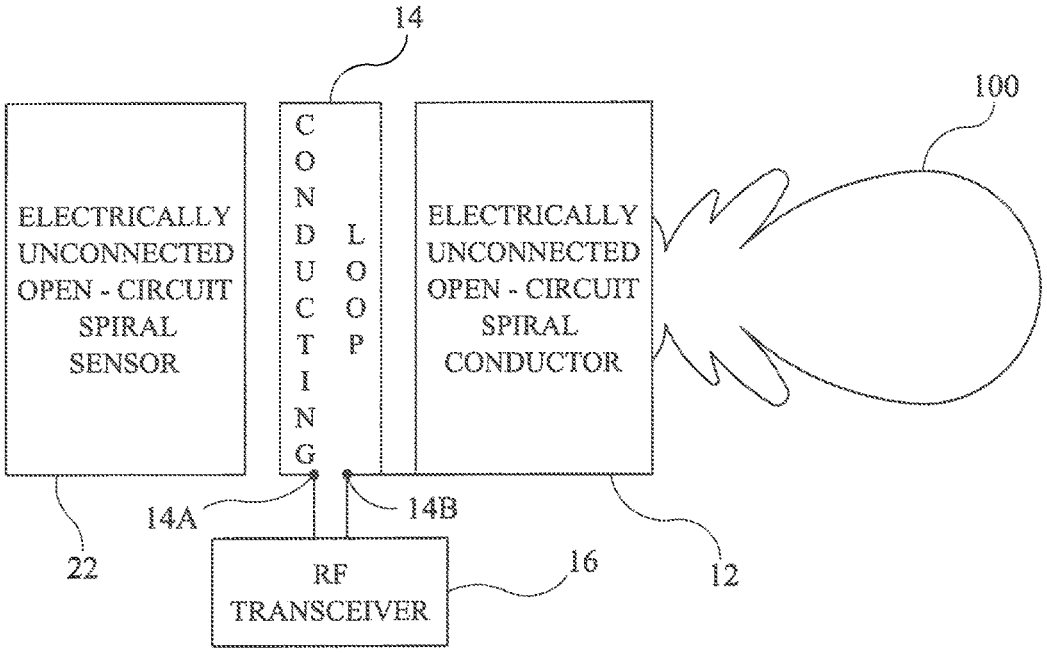
FIG. 8 is a schematic view of an antenna of the present invention paired with a wireless sensor to thereby increase the read range of the wireless sensor in accordance with another embodiment of the present invention.

As mentioned above, the antenna of the present invention can be used to increase the read range of wireless sensors such as those described in detail in the above-cited U.S. Pat. No. 8,430,327. Two exemplary embodiments of such use will be described with the aid of FIGS. 8 and 9. Referring first to FIG. 8, the above-described antenna 10 is paired with an electrically unconnected, open-circuit spiral sensor 22 having the same general attributes of spiral conductor 12 described earlier herein and in U.S. Pat. No. 8,430,327. Sensor 22 is electrically isolated from loop 14. Loop 14 is disposed between spiral conductor 12 and sensor 22, and is located close enough to sensor 22 such that loop 14 lies in the near field resonance pattern of sensor 22. As described in detail in the above-cited patent, sensor 22 experiences resonance changes when subjected to changes in environmental changes it has been designed to detect. However, these resonance changes only propagate in the near field of sensor 22. Antenna 10 detects the near field resonance of sensor 22 and propagates them into the far field in radiation pattern 100. That is, radiation pattern 100 is changed/modulated in accordance with resonance changes experienced by sensor 22. Radiation pattern 10 can then be detected by a conventional antenna (not shown). In this way, antenna 10 boosts or increases the read range of sensor 22.

Figure 9:
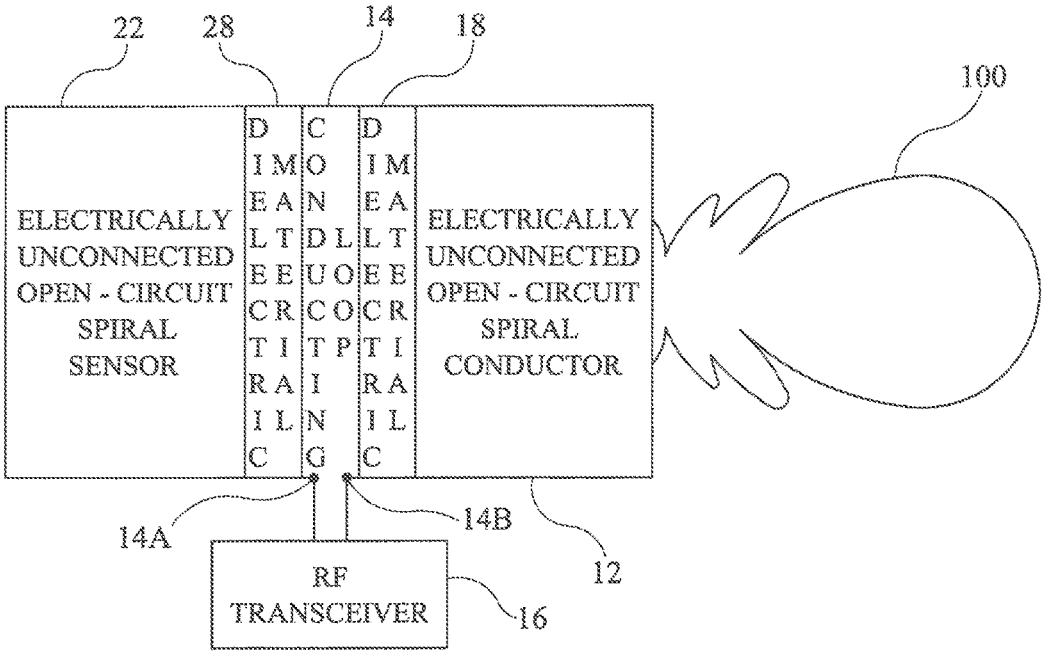
FIG. 9 is a schematic view of an antenna of the present invention paired with a wireless sensor with elements thereof formed in a one-piece structure in accordance with another embodiment of the present invention.

FIG. 9 illustrates another embodiment in which dielectric material is used to fix the relationships between spiral conductor 12, loop 14, and sensor 22, while also creating a one-piece structure. More specifically, dielectric material 18 is interposed between spiral conductor 12 and loop 14, and dielectric material 28 is interposed between loop 14 and sensor 22. Dielectric materials 18 and 28 can be the same or different without departing from the scope of the present invention. Dielectric materials could also encase spiral conductor 12, loop 14 and sensor 22 without departing from the scope of the present invention.

The advantages of the present invention are numerous. The antenna provides far field propagation and reception using simple, inexpensive, and low-power elements. The antenna's elements can be tuned for a variety of applications to include radio receiving antenna, a cellular phone antenna, a GPS antenna, a WiFi antenna, a military radar antenna, or any electromagnetic antenna that must be able to receive/radiate into the far field using small amounts of power. Accordingly, the present invention is well-suited to be paired with near-field-propagating wireless sensors to boost the read range associated with such sensors.

What is claimed is:

1. An antenna, comprising:

a first electrical conductor having first and second ends, said first electrical conductor shaped to form a first spiral between said first and second ends, said first and second ends remaining electrically unconnected such that said first electrical conductor so-shaped is maintained as an unconnected single-component open-circuit having inductance and capacitance wherein, in the presence of a time-varying electromagnetic field, said first electrical conductor so-shaped resonates to generate a radiation pattern;

a second electrical conductor including a loop portion overlapping at least a portion of said first spiral, said second electrical conductor being electrically isolated from said first electrical conductor;

a radio frequency transceiver electrically couple to said second electrical conductor for exciting said loop portion with electromagnetic energy wherein said time-varying electromagnetic field is generated in the presence of said first spiral; and a third electrical conductor having first and second ends, said third electrical conductor shape to form a second spiral between said first and second ends of said third electrical conductor, said first and second ends of said third electrical conductor remaining electrically unconnected such that said third electrical conductor so-shaped is maintained as an unconnected single-component open-circuit having inductance and capacitance, wherein said third electrical conductor so-shaped experiences resonance changes when subjected to environmental changes of interest, and wherein said loop portion is disposed between said first spiral and said second spiral, wherein said radiation pattern is modulated with said resonance changes.

2. The antenna of claim 1, farther comprising dielectric material disposed between said first spiral and said loop portion.

3. The antenna of claim 1, wherein said first spiral and said loop portion are aligned parallel to one another.

4. The antenna of claim 1, wherein said first spiral and said loop portion comprise elements of a one-piece structure.

5. The antenna of claim 1, wherein a center of said first spiral is aligned with a center of said loop portion.

6. The antenna of claim 1, wherein said first spiral resides in a first plane and said loop portion resides in a second plane parallel to said first plane.

7. The antenna of claim 1, further comprising dielectric material disposed between said first spiral and said loop portion, and between said second spiral and said loop portion.

8. The antenna of claim 7, wherein said first spiral, said loop portion, said second spiral, and said dielectric material comprise elements of a one-piece structure.

9. An antenna, comprising:

a first electrical conductor having first and second ends, said first electrical conductor shaped to form a first spiral between said first and second ends, said first spiral lying in a first plane, said first and second ends remaining electrically unconnected such that said first electrical conductor so-shaped is maintained as an unconnected single-component open-circuit having inductance and capacitance wherein, in the presence of a time-varying electromagnetic field, said first electrical conductor so-shaped resonates to generate a radiation pattern;

a second electrical conductor including a loop portion lying in a second plane, said loop portion overlapping at least a portion of said first spiral, said second electrical conductor being electrically isolated from said first electrical conductor;

a radio frequency transceiver electrically coupled to said second electrical conductor for exciting said loop portion with electromagnetic energy wherein said time-varying electromagnetic field is generated in the presence of said first spiral; and a third electrical conductor having first and second ends, said third electrical conductor shaped to form a second spiral between said first and second ends of said third electrical conductor, said second spiral lying in a third plane, said first and second ends of said third electrical conductor remaining electrically unconnected such that said third electrical conductor so-shaped is maintained as an unconnected single-component open-circuit having inductance and capacitance, wherein said third electrical conductor so-shaped experiences resonance changes when subjected to environmental changes of interest, and wherein said loop portion is disposed between said first spiral and said second spiral for detecting said resonance changes, wherein said radiation pattern is modulated with said resonance changes.

10. The antenna of claim 9, further comprising dielectric material disposed between said first spiral and said loop portion.

11. The antenna of claim 9, wherein said first plane and said second plane are parallel to one another.

12. The antenna of claim 9, wherein said first spiral and said loop portion comprise elements of a one-piece structure.

13. The antenna of claim 9, wherein a center of said first, spiral is aligned with a center of said loop portion.

14. The antenna of claim 9, wherein said first plane, said second plane, and said third plane are parallel to one another.

15. The antenna of claim 9, further comprising dielectric material disposed between said first spiral and said loop portion, and between said second spiral and said loop portion.

16. The antenna of claim 15, wherein said first spiral, said loop portion, said second spiral, and said dielectric material comprise elements of a one-piece structure.

17. An antenna, comprising:

a first electrical conductor having first and second ends, said first electrical conductor shaped to form a first spiral between said first and second ends, said first spiral lying in a first plane, said first spiral having a geometric center, said first and second ends remaining electrically unconnected such that said first electrical conductor so-shaped is maintained as an unconnected single-component open-circuit having inductance and capacitance wherein, in the presence of a time-varying electromagnetic field, said first electrical conductor so-shaped resonates to generate a radiation pattern;

a second electrical conductor including a loop portion lying in a second plane parallel to said first plane, said loop portion having a geometric center aligned with said geometric center of said first spiral wherein said loop portion overlaps at least a portion of said first spiral, said second electrical conductor being electrically isolated from said first electrical conductor;

a radio frequency transceiver electrically coupled to said second electrical conductor for exciting said loop portion with electromagnetic energy wherein said time-varying electromagnetic field is generated in the presence of said first spiral;

a third electrical conductor having first and second ends, said third electrical conductor shaped to form a second spiral between said first and second ends of said third electrical conductor, said second spiral lying in a third plane, said second spiral having a geometric center, said first and second ends of said third electrical conductor remaining electrically unconnected such that said third electrical conductor so-shaped is maintained as an unconnected single-component open-circuit having inductance and capacitance, wherein said third electrical conductor experiences resonance changes when subjected to environmental changes of interest, wherein said loop portion is disposed between said first spiral and said second spiral for detecting said resonance changes, said third plane is parallel to said first plane and said second plane, and said geometric center of said second spiral is aligned with said geometric center of said loop portion and said geometric center of said first spiral, wherein said radiation pattern is modulated with said resonance changes.

18. The antenna of claim 17, further comprising dielectric material disposed between said first spiral and said loop portion.

19. The antenna of claim 17, wherein said first spiral and said loop portion comprise elements of a one-piece structure.

20. The antenna of claim 17, further comprising dielectric material disposed between said first spiral and said loop portion, and between said second spiral and said loop portion.

21. The antenna of claim 20, wherein said first spiral, said loop portion, said second spiral, and said dielectric material comprise elements of a one-piece structure.

* * * * *